US008336730B2

(12) United States Patent
Pontes

(10) Patent No.: US 8,336,730 B2
(45) Date of Patent: Dec. 25, 2012

(54) PROTECTIVE SEAL APPLIED TO A BEVERAGE CAN AND A PROCESS OF APPLYING A PROTECTIVE SEAL TO BEVERAGE CANS AFTER CANNING THE BEVERAGE

(75) Inventor: Jacques Pontes, São Paulo (BR)

(73) Assignee: CBE—Companhia Brasileira De Embalagens S/A, Sao Paulo (BR)

( * ) Notice: Subject to any disclaimer, the term of this patent is extended or adjusted under 35 U.S.C. 154(b) by 589 days.

(21) Appl. No.: 12/603,886

(22) Filed: Oct. 22, 2009

(65) Prior Publication Data

US 2011/0011869 A1 Jan. 20, 2011

(30) Foreign Application Priority Data

Jul. 17, 2009 (BR) ..... 0902394

(51) Int. Cl.
*A47G 19/22* (2006.01)

(52) U.S. Cl. ..... 220/716; 220/265; 220/703; 220/781; 220/380; 206/508

(58) Field of Classification Search ..... 220/716, 220/200, 265, 260, 703, 718, 906, 781, 380; 206/217, 501, 503, 508, 821, 499; 215/250, 215/901
See application file for complete search history.

(56) References Cited

U.S. PATENT DOCUMENTS 3,013,687 A 12/1961 Gould
D192,539 S 4/1962 Terwilliger
D244,065 S 4/1977 Daenen
D248,216 S 6/1978 Allen et al.
4,166,552 A 9/1979 Faulstich
D286,026 S 10/1986 Rayner
D291,971 S 9/1987 Smith
4,917,258 A * 4/1990 Boyd et al. ..... 220/240
5,139,163 A * 8/1992 Diaz ..... 220/258.2
5,213,224 A 5/1993 Luch
5,273,176 A * 12/1993 Diaz ..... 220/258.2
5,346,088 A 9/1994 Brimo, II
D359,451 S 6/1995 Dees
D359,685 S 6/1995 Luch
5,452,818 A 9/1995 Yost
D381,906 S 8/1997 Bartsch
D389,058 S 1/1998 Landis
D415,420 S 10/1999 Chen
D419,447 S 1/2000 Molloy
D425,422 S 5/2000 David
6,073,797 A 6/2000 Barous
6,082,567 A 7/2000 Bietzer et al.
D436,862 S 1/2001 Witt et al.
(Continued)

FOREIGN PATENT DOCUMENTS

DE 43 13 375 A1 11/1993
(Continued)

*Primary Examiner* — Mickey Yu
*Assistant Examiner* — Kareen Rush
(74) *Attorney, Agent, or Firm* — Alston & Bird LLP

(57) ABSTRACT

A protective seal for application onto a beverage can, which is capable by virtue of its geometric configuration of providing efficient sealing against possible contamination that may come into contact with the upper outer portion of the can, and providing high resistance to penetration of substances and/or contaminants onto the can surface by virtue of the cooperation of compressive forces exerted by the surfaces of the protective seal onto the can.

8 Claims, 3 Drawing Sheets

U.S. PATENT DOCUMENTS

| | | | | |
|---|---|---|---|---|
| D445,030 | S | 7/2001 | Croft et al. | |
| D445,687 | S | 7/2001 | Gilbertson | |
| D447,056 | S | 8/2001 | Caserta | |
| D448,291 | S | 9/2001 | Melhede | |
| D462,269 | S | 9/2002 | Hunter et al. | |
| 6,443,323 | B1 | 9/2002 | DeRose | |
| D468,002 | S | 12/2002 | Steffan | |
| D489,005 | S | 4/2004 | Miceli et al. | |
| D489,610 | S | 5/2004 | Miceli et al. | |
| D489,620 | S | 5/2004 | Goodell et al. | |
| D492,596 | S | 7/2004 | Miceli et al. | |
| D495,600 | S | 9/2004 | Kouri | |
| D501,793 | S | 2/2005 | Carmichael et al. | |
| D503,620 | S | 4/2005 | Taylor | |
| D504,066 | S | 4/2005 | King | |
| D509,748 | S | 9/2005 | Carmichael et al. | |
| D512,636 | S | 12/2005 | Pace | |
| D515,429 | S | 2/2006 | Pace | |
| D517,408 | S | 3/2006 | Gonzalez | |
| D534,799 | S | 1/2007 | Henry et al. | |
| D543,857 | S | 6/2007 | Shu | |
| D547,652 | S | 7/2007 | Kerman et al. | |
| D550,078 | S | 9/2007 | Henry et al. | |
| 7,281,636 | B2 * | 10/2007 | Kim et al. | 215/254 |
| D564,356 | S | 3/2008 | Nickleberry | |
| D576,877 | S | 9/2008 | Alcamo et al. | |
| D584,613 | S | 1/2009 | Yan et al. | |
| D608,638 | S | 1/2010 | Pontes | |
| D609,091 | S | 2/2010 | Dubach | |
| D614,952 | S | 5/2010 | Caserta | |
| D633,790 | S * | 3/2011 | Pontes | D9/438 |
| 8,177,083 | B2 * | 5/2012 | Lamoureux et al. | 215/320 |
| 2003/0080130 | A1 * | 5/2003 | Goetz et al. | 220/253 |
| 2006/0231563 | A1 * | 10/2006 | Olivar | 220/780 |
| 2009/0320741 | A1 | 12/2009 | Pontes | |

FOREIGN PATENT DOCUMENTS

| | | | |
|---|---|---|---|
| GR | 1004381 | B1 | 11/2003 |
| JP | 3148492 | A | 6/1991 |
| MU | 8301816-6 | U | 4/2005 |
| MU | 8303346-7 | U | 7/2005 |
| MU | 8501669-1 | U | 12/2005 |
| WO | WO 01/15990 | A1 | 3/2001 |

* cited by examiner

PROTECTIVE SEAL APPLIED TO A BEVERAGE CAN AND A PROCESS OF APPLYING A PROTECTIVE SEAL TO BEVERAGE CANS AFTER CANNING THE BEVERAGE

BACKGROUND OF THE INVENTION

The present invention relates to a protective seal, applicable to cans made of aluminum or the like for beverages, particularly designed to provide efficient sealing and prevent contamination, preventing dirt and pathogenic agents from coming into contact with the upper outer portion of the can. Such sealing capability usually results from the geometrical constitution of the seal and the can, which brings about cooperation between surfaces of the seal and of the can, thus generating compressive forces that prevent any substance from getting in.

The growing demand for disposable containers and/or utensils in the past few decades has promoted the development of numberless products intended for storing and carrying a series of materials.

More particularly, it is known that the consumption of beverages stored in disposable aluminum-type cans has greatly stimulated the production and marketing of containers especially designed to meet the needs of the final consumer.

The physical and/or geometrical characteristics of this type of can are now important aspects when it comes to the handling thereof and/or the possibility of storing and stacking them up.

Additionally, contamination of the upper outer surface of the can, which is the surface that comes into contact with the consumer's mouth, is commonplace as a result of inadequate storing of such containers in places that lack minimum hygiene condition, such as storehouses and sheds, or in excessively humid places.

A few prior-art solutions have attempted to provide a protective product that could meet the requirements of storage of such cans in contaminated environments.

Patent document MU 7701753-6 discloses a plastic cover that is coupled by mechanical pressure onto the upper part of a can-type metallic container.

Such a cover tries to provide a protective mechanism to the outer surface of the can, mainly for cases in which there may be contact of contaminating agents with that surface.

The prior art MU 7701753-6 does not disclose a cover or a protector for beverage cans, especially designed to prevent substances or contaminating agents from penetrating, in situations in which the can is stored, for example, in containers filled with water or ice, that is to say, in cases in which the cans are submerged. The device disclosed therein does not have geometric characteristics that enhance performance with regard to efficient sealing.

Similarly, Brazilian patent documents MU 8301816-6, MU 8303346-7, PI 0006387-8, MU 8201007-2, MU 8201044-7, PI 0002523-2, and MU 7802409-9 disclose protectors for beverage cans formed by a polymeric material and positioned at the upper portion of the can, without, however, providing a protective mechanism capable of preventing contamination of the can in extreme cases, such as when the can is dipped into a surrounding liquid and is exposed to contaminating agents.

On the basis of the foregoing, there is a need for the development of a truly effective protective seal as far as its sealing and protecting properties against contaminating agents are concerned.

Thus, the present invention provides an efficient protective seal for the upper surface of the can, the protector being capable of providing a secure and effective sealing system, even when the can is submerged, on the basis of the constructive characteristics and cooperation between the surfaces of the protector and the can surface.

BRIEF SUMMARY OF THE DISCLOSURE

An objective of the present invention is to provide a protective seal, especially applicable to beverage cans, which is capable of providing efficient sealing and preventing contamination, preventing dirt and pathogenic agents from coming into contact with the upper outer portion of the can as a result of its geometric construction, which brings about cooperation between seal surfaces and can surfaces, generating compressive forces that prevent any substance from getting in.

Another objective of the present invention is to provide the protective seal such that, in addition to all the characteristics indicated above, it has an extremely reduced manufacture cost, thus enabling a commercial application thereof on a large scale.

The objectives of the present invention are achieved by means of a protective seal applied to beverage cans, comprising a first circular protection wall and a second circular protection wall, the first circular protection wall having a first inner contact surface and a first outer surface opposite the first inner contact surface, the second circular protection wall having a second inner contact surface and a second outer surface, the first circular protection wall being associated, from an upper joining portion, to the second circular protection wall, the first inner contact surface and the second inner contact surface defining a groove therebetween for engagement with the upper portion of the can, the first inner contact surface having an annular engagement portion arranged inside and underneath at the first circular protection wall, a circular protective flap projecting from the lower end of the first circular protection wall, the seal being such that a first upper circular engagement portion defines a first sealing portion, the upper joining portion defines a second sealing portion, and the circular protective flap defines a third sealing portion, cooperation between the first, second, and third sealing portions defining a sealing system against penetration of contaminating agents into the upper portion of the can.

The objectives of the present invention are also achieved by means of a protective seal applicable to beverage cans, comprising a first circular protection wall and a second circular protection wall, the first circular protection wall having a first inner contact surface and a first outer surface opposite the first inner contact surface, the second circular protection wall having a second inner contact surface and a second outer surface, the first circular protection wall being associated, from an upper joining portion, to the second circular protection wall, the first inner contact surface and the second inner contact surface defining a groove therebetween for engagement with the upper portion of the can, the first inner contact surface having an annular engagement portion arranged inside and underneath at the first circular protection wall, a circular protective flap projecting from the lower end of the first circular protection wall, the seal being such that it comprises a sealing system against penetration of contaminating agents into the upper portion of the can, the sealing system comprising an upper circular engagement portion, the upper circular engagement portion defining a first sealing portion, the upper joining portion defining a second sealing portion, the protective flap defining a third sealing portion, the sealing system acting by cooperation between the first, second, and third sealing portions.

Further, the objectives of the present invention are achieved by means of a process of applying a protective seal to a beverage can after the beverage has been canned, which comprises the following steps:

Step a)—positioning each can in a given region of the production line;

Step b)—providing asepsis of each can positioned in said region of the production line;

Step c)—fitting or engaging the protective seal, as defined above, with an upper outer portion of the can.

BRIEF DESCRIPTION OF THE DRAWINGS

The present invention will now be described in greater detail with reference to the attached drawings, in which.

DETAILED DESCRIPTION OF THE DRAWINGS

Figure 1:
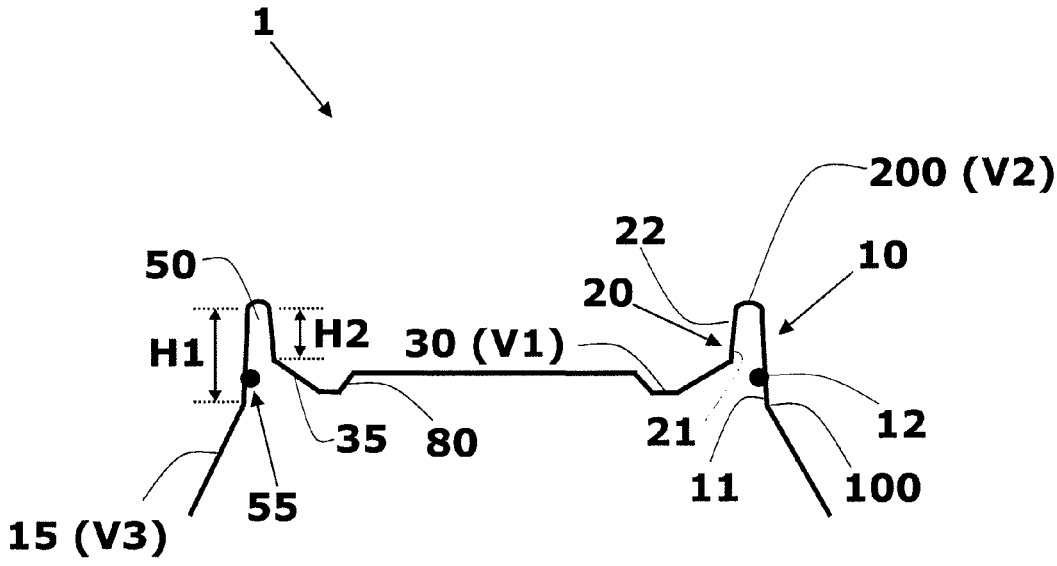
FIG. 1 is a schematic cross-sectional view of the protective seal in accordance with one embodiment of the present invention.

An analysis of the prior-art documents above shows that the solutions known at present do not provide a protective seal for use on beverage cans that is specially designed for efficient sealing and that adequately prevents possible substance contamination of the upper portion of the can, particularly in cases where the can is submerged in a liquid environment and is exposed to contaminating agents.

With a view to provide a protective seal for application to the upper surface of aluminum cans or the like for packing beverages, such as beer, energy drinks, and/or cooling beverages, the present invention is proposed.

More particularly, the proposed protective seal 1, applied to beverage cans, comprises a main body having a shape that is substantially analogous to the upper portion of the can, so as to achieve a tight fitting and effective cooperation, thus making the sealing extremely efficient.

In essence, the main body comprises an annular circular protrusion defining a lower opening that is closed by a substantially plane circular surface, so as to cover completely the upper portion of the can when the seal is installed.

The annular circular protrusion comprises a first circular protection wall 10 and a second circular protection wall 20, which are concentric and associated with each other. The second circular protection wall 20 defines an internal area filled by said substantially plane circular surface, which actually can be described as first and second concentric fitting circular portions 30, 31 (see FIGS. 1 and 2). The first upper fitting circular portion 30 has a recessed annular shape, at the inner limit of which a second fitting circular portion 31 is provided on a higher plane.

The first upper fitting circular portion 30 is associated to the second circular protection wall 20 by means of an annular circular portion formed as a ramp 35, while said first circular portion 30 is associated, by means of an inclined wall 80, to the second upper fitting circular portion 31, which preferably occupies a hypothetical upper plane.

Such characteristics, as will be seen later, are of fundamental importance so that the protective seal will be enormously more efficient with respect to the capability of keeping the upper can portion free from contaminants, if compared with the products known at present.

Figure 2:
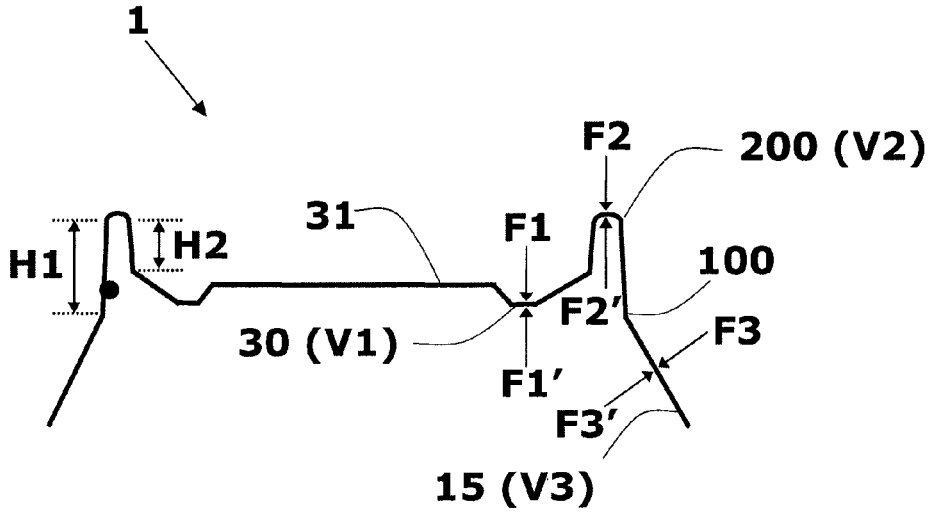
FIG. 2 is a second schematic cross-sectional view of the protective seal.

It should be pointed out that, from a geometric point of view, the first fitting circular portion 30 and the second 31 fitting circular portion, as well as the ramp 35 and the inclined wall 80, when combined, define the substantially plane circular protection surface, and a cross-section thereof is substantially trapezoidal (see FIGS. 1 and 2).

Figure 4:
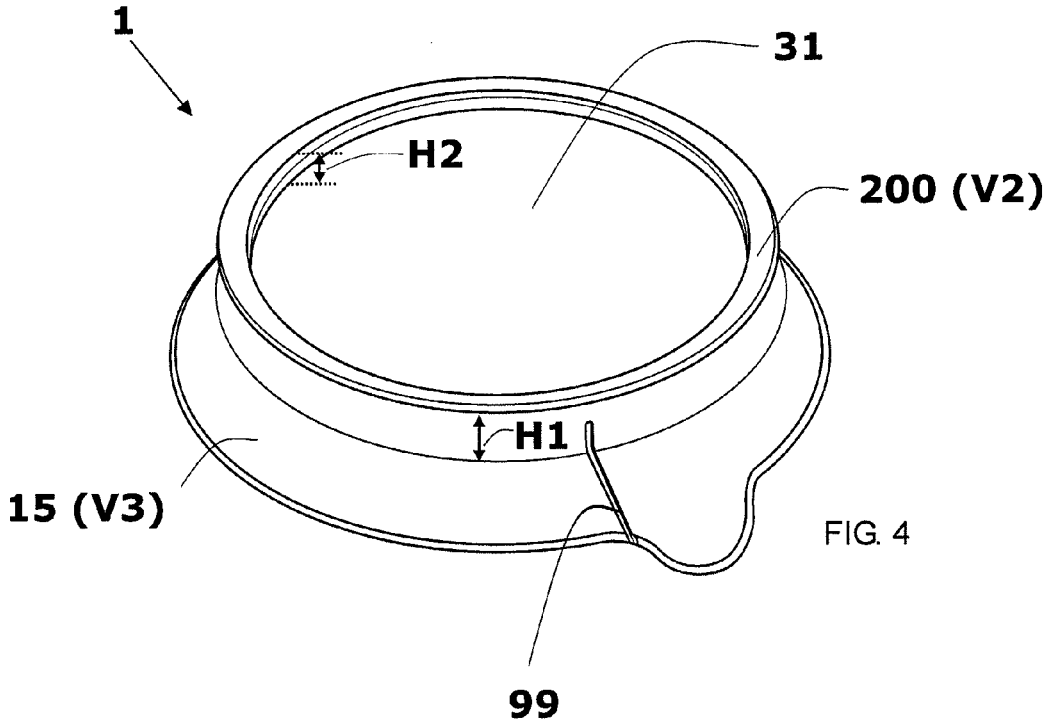
FIG. 4 is a first perspective view of an embodiment of the protective seal of the present invention.
Figure 5:
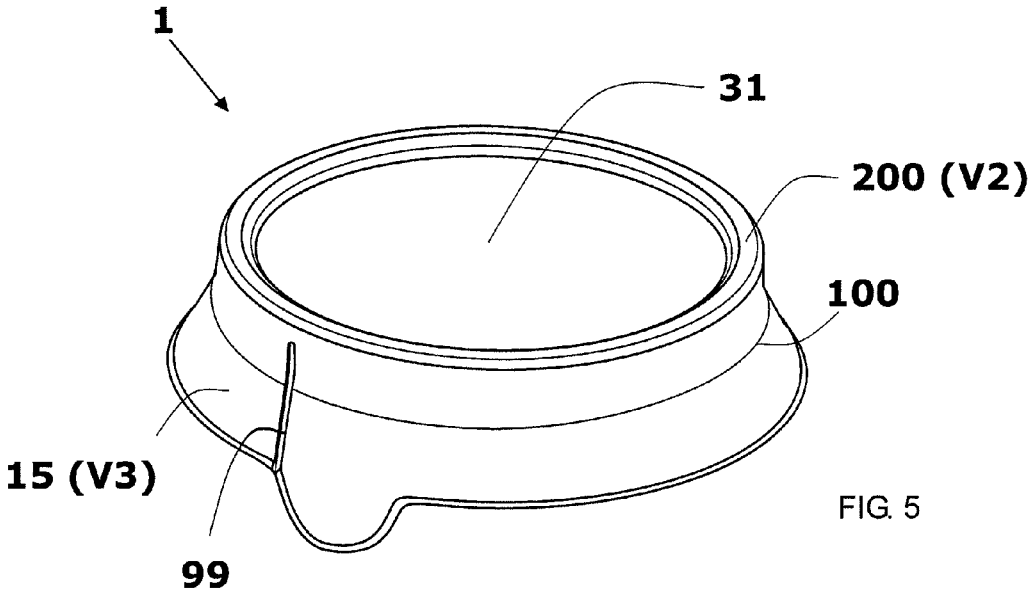
FIG. 5 is a second perspective view of an embodiment of the protective seal of the present invention.
Figure 6:
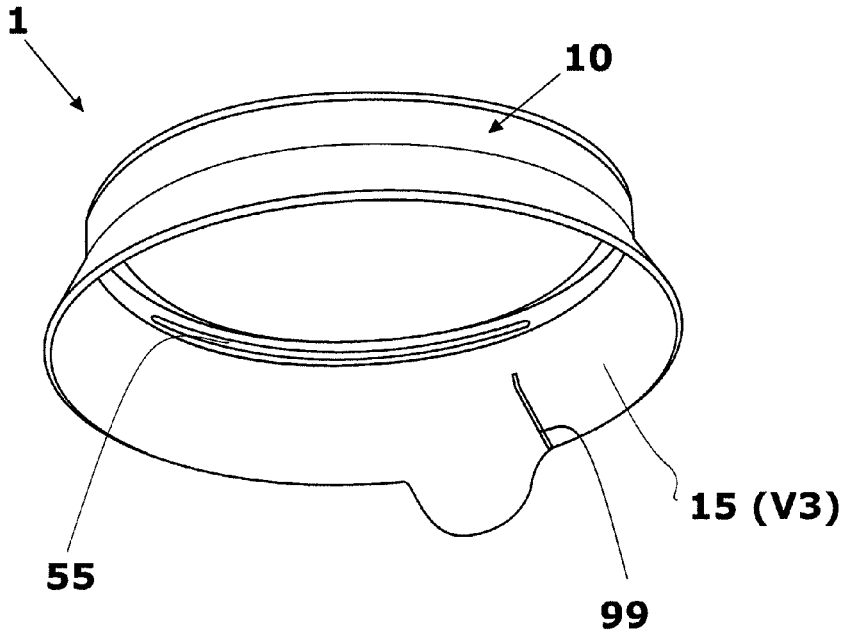
FIG. 6 is a lower perspective view of an embodiment of the protective seal of the present invention.

The second upper fitting circular portion 31 is what closes much of the upper can portion, preventing dirt from contacting it. FIGS. 4 to 6 show the second portion 31 in a possible and not limiting embodiment of the protective seal 1.

As can be seen in FIG. 1, the first circular protection wall 10 has a first inner contact surface 11 and a first outer surface 12 opposite the first inner surface 11. Similarly, the second circular protection wall 20 has a second inner contact surface 21 and a second outer surface 22.

The first circular protection wall 10 is associated to the second circular protection wall 20 by means of a substantially annular and vaulted upper joining portion 200, which is common to the first 10 and the second 20 protection walls.

A technically important constructive characteristic of the presently claimed seal relates to the first and second inner contact surfaces 11, 21, which are preferably positioned at a slight angle, preferably greater than 0° (zero degrees) and smaller than 10° (ten degrees) relative to a longitudinal axis of the can, so as to define between them a substantially annular fitting channel 50, which cooperates with the annular protrusion existing on the upper surface of the can. Preferably the fitting channel 50, as shown in FIG. 1, is substantially V-shaped in cross-section.

Additionally, the inner contact surface 11 has, as shown in FIG. 1, an annular fitting protrusion 55 arranged inside and beneath at the first circular protection wall 10, the particular configuration of which may vary freely without the resulting seal failing to be included in the protection scope of the appended claims.

The annular fitting protrusion 55 aids in the structural rigidity of the seal and in its coupling/locking with the upper can portion. When the protective seal is coupled to the beverage can, the annular protrusion 55 is locked with an annular protrusion existing on the can. The locking is such that the seal will be firmly locked and deforms, as described in greater detail below. The shape of the protrusion 55 may vary freely, as long as it is functional.

Preferably, the annular fitting protrusion 55 has a thickness of about 1 mm. However, other thicknesses may be employed for the present protector, in order to prevent it from detaching when fitted.

Further, a circular protective flap 15 projects from a lower end 100 of the first circular protection wall 10. Such a flap 15 provides an auxiliary sealing to prevent contaminants from getting on the upper region of the can. Additionally, the flap constitutes an aesthetic element that can be used for displaying varied sayings, such as the name of the beverage stored in the can, promotional expressions, etc.

Finally, FIGS. 1, 2, and 4 show that the first circular protection wall 10 has a first height H1 preferably greater than a second height H2 of the second circular protection wall 20. The first height H1 corresponds to the distance between the lower end 100 of the first circular protection wall 10 and the upper joining portion 200, while the second height H2 corresponds to the distance between the beginning of the circular ramp 35 and the upper joining portion 200.

Figure 3:
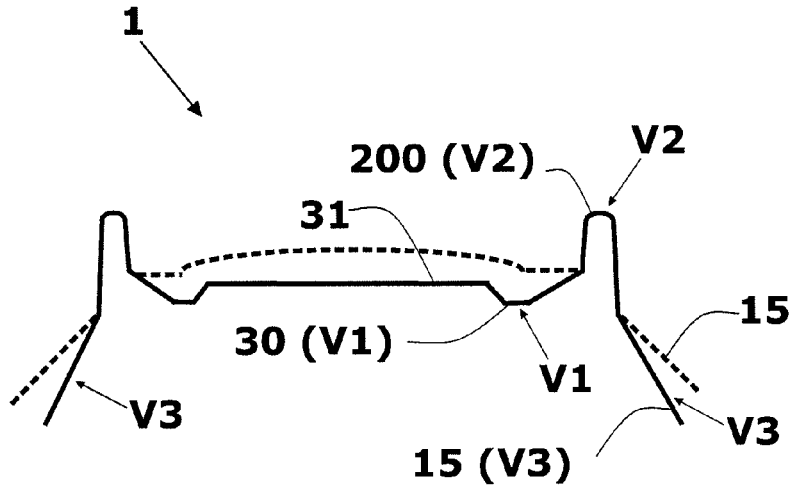
FIG. 3 is a third schematic cross-sectional view of the protective seal, pointing out in dashed line the sealing movement of the seal and the vaulting of its upper engagement portion.

One innovative characteristic of the protective seal 1 over the prior art is the efficient sealing system it provides. FIGS. 2 and 3 highlight in greater detail the forces acting on the surfaces of the present object, making clear that the present protective seal 1 is very efficient to guarantee asepsis and tightness at the upper can portion, where the user will place his mouth for consumption, due to the fact that it has a threefold sealing system.

More specifically, the threefold sealing system corresponds to the existence of three sealing elements on the seal (V1, V2, V3), in the form of three regions that come into contact with the beverage can and prevent, with great efficiency, penetration of any contaminant in solid, liquid, or gaseous form.

Each of the three sealing elements (V1, V2, V3) on its own is extremely efficient in its function of preventing the passage of any foreign body. Moreover, since the three elements (V1, V2, V3) operate successively, it is virtually impossible that a foreign body can manage to pass through these three barriers and reach the upper surface of the can.

The first sealing element V1 is composed of the first upper fitting portion 30, which presses the upper portion of the can when the seal 1 is correctly attached to it.

The second sealing element V2 is composed of the upper joining portion 200, which cooperates with the corresponding annular protrusion existing on the upper surface of the can, pressing it when the seal is correctly attached to it.

Finally, the third sealing element V3 is composed of the circular protective flap 15, which presses the side wall of the can, just below the annular protrusion.

The efficiency of the seal 1 as far as sealing is concerned is due to its ingenious configuration and to the elastic deformation that it undergoes when it is correctly applied to the can, whereby each of the sealing elements applies a normal force component onto the can surface, thus guaranteeing the sealing.

In particular, when the seal 1 is applied or snapped over the upper can portion, the annular fitting protrusion 55 locks just below the annular protrusion existing on the can surface. The locking force is great and sufficient to keep the seal attached to the upper portion of the can, even if, in this position, it deforms elastically.

When the seal 1 is locked by the annular fitting protrusion 55, its central portion undergoes deformation, due to the fact that the first and second circular portions 30, 31 touch the upper surface portion of the can. In order for the seal to remain at a rest position without deforming, it would be necessary for the first and second circular portions 30, 31 to be in a lower position than they are able to assume, due precisely to the interference with the upper surface portion of the can. In other words, the upper portion of the can prevents the first and second circular portions 30, 31 from reaching the position that would be natural for the seal to be at a rest position without undergoing any elastic deformation.

As a result of the interference and the consequent deformation, the circular ramp 35 assumes a more horizontal orientation, and the second circular portion 31 becomes slightly vaulted or domed, thus defining a substantially spherical surface as shown in FIG. 3. Since the portions 35 and 31 have deformed, they tend to return to their rest position and consequently they apply a contrary force to overcome the resistance presented by the upper portion of the can. In practice, the first circular portion 30 (first sealing element V1) applies a normal force F1 substantially perpendicular to the can surface, which in turn, because of the physical principle of action and reaction, applies a force F1' of the same magnitude but opposite in direction, onto the circular portion. These two forces entail the strong compression between the first circular portion 30 and the can, causing deformation of the portion 30 and preventing passage of any foreign body.

In identical manner, when the seal 1 is mounted on the can, the locking force brought about by the protrusion 55 causes deformation of the upper joining portion 200 (second sealing element V2), which, because of its tendency to return to the rest position, applies onto the can a normal force F2. The inexorable action-and-reaction law causes the can to apply a force F2' of the same magnitude but opposite direction onto the circular portion. These two forces entail the strong compression between the upper joining portion 200 and the can, preventing the passage of any foreign body.

Finally, when the seal 1 is mounted on the can, the flap 15 (third sealing element V3) touches it right below the annular protrusion 55. However, at this point the diameter of the can is larger than that of the flap, forcing the flap to an unnatural position and deforming it elastically. Thus, because of its tendency to return to the rest position, the flap 15 applies a normal force F3 onto the can. The inexorable action-and-reaction law causes the can to apply a force F3' of the same magnitude but opposite direction onto the circular portion. These two forces bring about the strong compression between the flap 15 and the can, preventing the passage of any foreign body.

More particularly, the cooperation of efforts takes place through the annular fitting protrusion 55, the first, second, and third normal forces F1, F2, F3, and first, second, and third reaction forces F1', F2', F3'. In this way, the annular fitting protrusion 55 is capable of keeping the protective seal in contact with the upper portion of the can, reacting against the action of the first, second, and third reaction forces F1', F2', F3'.

Since each of the three sealing elements V1, V2, V3 alone is already extremely efficient, the sum of their respective effects makes the present seal extremely efficient in its function. This is because, in order for any impurity or contaminant to reach the upper portion of the can, it would have to pass through all three sealing elements, which is virtually impossible. Such characteristics doubtlessly evidence an innovative system over the solutions available today in the field of application of the invention.

Such cooperation of forces enables the beverage can, such as a beer or soft-drink can, to be handled and/or stored in situations in which it is submerged in water or ice, as for instance, in expanded-polystyrene packages, since the strength of the present protector provides an important and significant barrier against penetration of contaminants to the upper portion of the can.

Finally, preferably the protective seal 1 has some type of tampering indicator 99, preferably in the form of a weakening (or frangible) line, which breaks at the moment when the consumer removes the seal from the can. Since it is impossible to remove the seal without breaking the weakening line 99, it becomes impossible to tamper with the seal without this being noticeable. The anti-tampering system may vary freely, being known to those skilled in the art.

Preferably, the seal 1 is applied to the beverage can at the moment immediately following the canning of the product, still at the beverage factory. As a general rule, the beverage is canned and then hermetically closed right away. Immediately after being closed, the can is cleaned and sterilized, so as to eliminate any dirt and impurity, and then the present protective seal 1 is applied.

Since the seal 1 prevents the penetration of dirt and contaminants, it guarantees sterility of the can portion that comes into contact with the consumer's mouth, until the seal is removed. The maker of the beverage can guarantee that, except in case of removal of the seal, the can will be absolutely aseptic and sterilized when the consumer removes the seal, and the latter may consume the beverage without worries about contamination. Even deliberate attempts at contamination will be made difficult, by virtue of the tampering indicator 99.

Such guarantee is doubtlessly an enormous advantage for the consumer, who can be sure that there will be no risk for his health if he opens the can and drinks the beverage. Such guarantee is also an enormous advantage and reassurance that the manufacture of the beverage can offer to consumers.

In order to assess the sealing effectiveness of the present seal, tests for tightness were developed at the renowned Instituto de Pesquisas Tecnológicas (IPT) (Technological Research Institute) and at the Centro de Tecnologia de Embalagem (CETEA) (Packing Technology Center), two Brazilian institutions of the highest renown and reputation.

The tests carried out by the IPT, presented and commented in an official measurement report No. 6071-204, showed that there was no penetration of water under the seals of the cans that were tested in all the evaluated positions, namely:

- two cans in the vertical position with the cover turned upward;
- two cans in the vertical position with the bottom turned upward; and
- three cans in the horizontal position.

Further with regard to the methodology employed in the tests for tightness for the presently proposed seal, said tests were conducted for a period of 30 minutes with application of external hydraulic pressure of 0.29 bar, equivalent to 2.4 m of water. The water placed within the cylinder was at a temperature of 23° C.

Each can was housed inside a cage, in the above cited positions. The cage was put inside a cylinder with water, guaranteeing that the cans would remain immersed during the application of the external hydraulic pressure. Then, the cylinder was hermetically closed.

The tests carried out by the IPT confirmed once again the efficiency achieved with the protective seal of the present invention as far as its sealing power against penetration of possible dirt in a contaminated environment is concerned.

The tests developed by the a reputable Brazilian institute called "Centro de Tecnologia de Embalagem" enabled one to evaluate the performance of the present seal with respect to the maintenance of the microbiological quality of the outer surface of the aluminum cover of the can, so as to assess possible contamination of this region.

The evaluation was carried out by considering that such cans are subjected to cooling in containers containing ice. More particularly, the tests were carried out such that some cans provided with the present protective seal were exposed to sterile water, and other cans provided with the present protective seal were exposed to water having a high degree of contamination by a strain of the *Escherichia coli* bacterium. The cans were put in separate plastic boxes for analysis in each case.

It should be noted that the preparation of contaminated water was carried out by adding the strain of the *Escherichia coli* bacterium to sterile water, which at the end of the procedure resulted in a count of $2.6\times10^5$ Colony Forming Units (CFU)/mL of *Escherichia coli.*

In a first plastic box, 10 cans were placed in a lying position, submerged in ice-cold contaminated water. The whole procedure of the tests was carried out by the CETEA vertical-model Veco laminar flow hood.

It should be noted that, after every 30 (thirty) minutes, there was movement of the boxes.

After three hours, the cans were removed from the box at random, momentarily turned upside down in order to remove accumulated liquid, packed in sterile plastic bags with the bottom turned downward and stored at cooling temperature for about 15 hours. Then the cans were analyzed for contamination by *Escherichia coli.*

For the analysis of the surface of the cover under the present protective seal, the cans were removed from the sterile bags in aseptic conditions, and the outer surface of the seal was cleaned with alcohol and dried, in order to ensure that no contamination would take place in the packing procedure.

Table 1 below presents the results achieved in the quantification of *Escherichia coli* on the cover surface after contact with sterile water. Table 2 shows the results achieved with contaminated water.

TABLE 1

Results of the microbiological evaluation, in CFU/can, of the outer surface of the cover of cans packed in the box 1 (sterile water):

| Can | *E coli* count (CFU/can) on the cans immerged into sterile water |
|---|---|
| 1 | <10 |
| 2 | <10 |
| 3 | <10 |
| 4 | <10 |
| 5 | <10 |
| 6 | <10 |
| 7 | <10 |
| 8 | <10 |
| 9 | <10 |
| 10 | <10 |

TABLE 2

Results of the microbiological evaluation on CFU/can of the outer surface of the cans packed in box 2 (high contamination)

| can | *E. coli* count (CFU/can) on the cans immersed in water with high contamination |
|---|---|
| 1 | <10 |
| 2 | <10 |
| 3 | <010 |
| 4 | <10 |
| 5 | <10 |
| 6 | <10 |
| 7 | <10 |
| 8 | <10 |
| 9 | <10 |
| 10 | <10 |
| 11 | <10 |
| 12 | <10 |
| 13 | <10 |
| 14 | <10 |
| 15 | <10 |
| 16 | <1- |
| 17 | <10 |
| 18 | <10 |

TABLE 2-continued

| Results of the microbiological evaluation on CFU/can of the outer surface of the cans packed in box 2 (high contamination) | |
|---|---|
| can | *E. coli* count (CFU/can) on the cans immersed in water with high contamination |
| 19 | <10 |
| 20 | <10 |

The results above show that, according to the tests, no presence of *Escherichia coli* was found on the cans that were immersed in sterile water, thus confirming that there was no previous contamination on the cans sent for study.

Table 2 shows that no presence of the *Escherichia coli* bacterium was found on the cover of cans protected by the presently proposed seal, for the cans that were immersed in water with high contamination. In the tests developed by the CETEA, one considers as non-contamination the presence a value lower than 10 colony-forming units per can (CFU/can).

The results achieved and presented by the CATEA prove the efficiency of the seal of the present invention in preventing contamination of the can surface when the can is exposed to high level of contamination.

Additionally, it should be pointed out that the geometric characteristics of the present seal, combined with the raw material employed in manufacturing it, impart to the process of applying the seal 1 onto the can a mounting/riveting speed many times as high as with the old methods, which can reach 120,000 cans/hour or even more.

The speed of applying the seal 1, according to the teachings of the present invention, is achieved with the constructive characteristics of the seal associated to the proposed material, the latter being preferably constituted by polyethylene of medium linear density, having a melt flow index of about 50 grams per 10 seconds.

The protective seal 1 of the present invention is developed and manufactured to have a weight ranging from 1 to 5 g. Still more preferably, the protective seal proposed has a thickness ranging from 0.2 to 0.9 mm.

However, the constituent material and the mass of the seal may vary freely without it failing to being included within the protection scope of the appended claims.

Finally, the process of applying the present protective seal onto beverage cans after the beverage has been canned is a further novel and inventive development, this process having the following steps:

Step a) positioning each can in a region of the production line;

Step b) promoting the asepsis of each can positioned in the given region of the production line; and Step c) fitting or riveting the protective seal 1 of the present invention onto an upper outer portion of the can.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A protective seal applicable to an upper portion of a beverage can for sealing against intrusion of contaminants in solid, liquid, or gaseous form that could contaminate the top of the can, the protective seal being formed of an elastically deformable material and being configured to be elastically deformed by interference between the protective seal and the beverage can when applied to the beverage can, the protective seal comprising a generally horizontal top panel defining an annular sealing portion that projects downwardly for contacting a top surface of the beverage can when the protective seal is applied thereto, the protective seal comprising an inverted U-shaped sealing channel formed by an inner wall joined to the annular sealing portion and extending generally upwardly therefrom, an upper joining portion joined to an upper end of the inner wall, and an outer wall joined to the upper joining portion and extending generally downwardly therefrom, the sealing channel being configured to receive an upper rim of the beverage can when the protective seal is applied thereto, the protective seal further comprising an annular fitting protrusion projecting radially inwardly from an inner surface of the outer wall of the sealing channel and located to contact a side wall of the beverage can below the upper rim thereof, the protective seal further including a generally conical flap extending downwardly and outwardly from a lower end of the outer wall and configured to be elastically deformed radially outwardly when the protective seal is applied to the beverage can;

wherein the protective seal is configured such that when the protective seal is snapped over the upper portion of the can, the annular fitting protrusion locks just below an annular protrusion existing on the can to produce a locking force sufficient to keep the seal attached to the upper portion of the can, and the annular sealing portion abuts the top surface of the can, the top surface of the can preventing the annular sealing portion from reaching a rest position in the absence of any elastic deformation, causing the top panel of the protective seal as a whole to become slightly domed upwardly and exert a restoring force F1 that presses the annular sealing portion against the top surface of the can, the locking between the annular fitting protrusion and the can further causing deformation of the upper joining portion which, because of its tendency to return to a rest position, applies a normal force F2 downwardly onto the rim of the can, and the flap being deformed elastically outwardly by interference with a side wall of the can and, because of a tendency of the flap to return to a rest position, the flap applying a normal force F3 onto the side wall of the can.

2. The protective seal of claim 1, wherein the inner wall and the outer wall forming the sealing channel are positioned at an angle with respect to each other so as to give the sealing channel a tapered configuration that narrows in an upward direction, wherein said angle is greater than 0 degrees and smaller than 10 degrees.

3. The protective seal of claim 1, wherein the inner wall is joined to the annular sealing portion of the top panel by an intervening ramp that is inclined upwardly in a radially outer direction.

4. The protective seal of claim 1, wherein the annular sealing portion of the top panel is joined through an inclined wall to a circular upper portion, the circular upper portion being higher than the annular sealing portion when the protective seal is in an undeformed rest condition.

5. The protective seal of claim 1, wherein the outer wall has a first height H1 that is greater than a second height H2 of the inner wall.

6. The protective seal of claim 1, wherein the protective seal has a weight ranging from 1 to 5 g.

7. The protective seal of claim 1, wherein the protective seal has a wall thickness ranging from 0.2 to 0.9 mm.

8. The protective seal of claim 1, wherein the protective seal is constituted by polyethylene material of medium linear density.

* * * * *